United States Patent [19]

Aldred

[11] 3,934,525

[45] Jan. 27, 1976

[54] TEXTILE PROCESS

[75] Inventor: Justin Anderson Aldred, Manchester, England

[73] Assignee: Ilcor GmbH, Chur, Switzerland

[22] Filed: Apr. 30, 1975

[21] Appl. No.: 573,084

Related U.S. Application Data

[63] Continuation-in-part of Ser. No. 428,051, Dec. 26, 1973, abandoned.

[52] U.S. Cl. ..... 112/217; 38/1 B; 112/147; 112/262

[51] Int. Cl.[2] ..... D05B 35/02; D06F 71/30

[58] Field of Search ..... 112/136, 147, 148, 153, 112/2, 41, 217, 235, 262; 38/1 B, 2, 3

[56] References Cited

UNITED STATES PATENTS

| | | | |
|---|---|---|---|
| 528,468 | 10/1894 | Emmons | 112/217 X |
| 1,549,484 | 8/1925 | Gardner | 112/217 |
| 1,683,412 | 9/1928 | Rosenbaum et al. | 112/217 X |
| 1,702,271 | 2/1929 | Rosenbaum et al. | 112/217 X |
| 1,809,460 | 6/1931 | Weis | 112/217 X |
| 1,988,241 | 1/1935 | Gardner et al. | 112/217 |
| 2,473,236 | 6/1949 | Barlow | 112/217 X |
| 2,753,823 | 7/1956 | Judelson | 112/217 |
| 3,246,616 | 4/1966 | Korioth | 112/2 |
| 3,587,496 | 6/1971 | Timby | 112/217 |
| 3,659,537 | 5/1972 | Sigoda | 112/217 |

*Primary Examiner*—H. Hampton Hunter
*Attorney, Agent, or Firm*—Oblon, Fisher, Spivak, McClelland and Maier

[57] ABSTRACT

A seam is set by pressing while the seam allowances are folded to lie flat against the fabric reverse sides while the fabric face sides are facing each other by running the fabric through a seam allowance separator and folder with the seam constrained against lateral displacement. The constraint may comprise the needle, presser foot and feeder of a sewing machine producing the seam.

18 Claims, 7 Drawing Figures

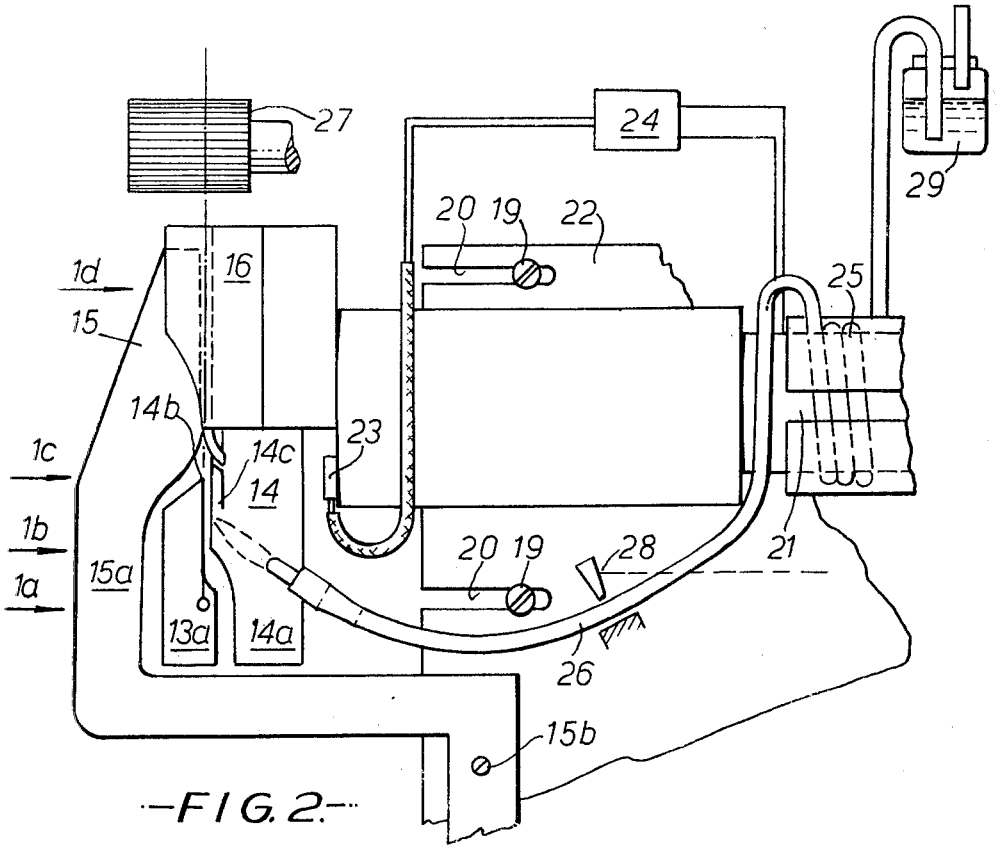
-FIG. 2.-
-FIG. 3.-
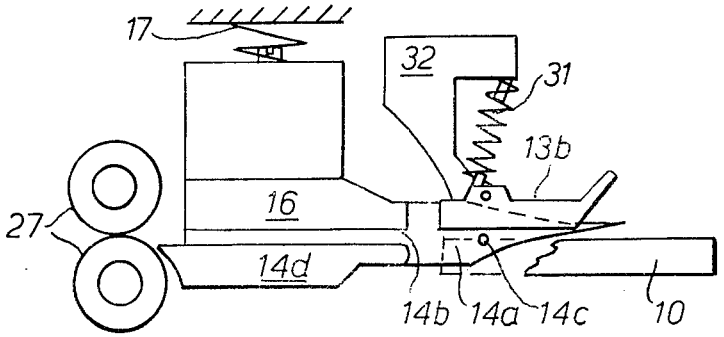

TEXTILE PROCESS

This application is a continuation-in-part of Ser. No. 428,051 filed Dec. 26, 1973, now abandoned.

The invention relates to setting seams joining two plies of fabric having face sides and reverse sides similarly orientated with respect to the seam, and seam allowances.

BACKGROUND TO THE INVENTION

Seams are produced during garment fabrication by sewing or perhaps, in the case of thermoplastic material, welding or otherwise joining together two plies of material face side to face side along a line adjacent their edges. (It is not, of course, necessary for the face side to be distinguishable from the reverse side of either ply, although it is commonly so in textile fabrics.) The narrow strip of each ply between the sewing, welding or other joining line and the edge of the material is the "seam allowance." It is usual to press these seam allowances, as by a flat iron, in a separate pressing operation after the garment has been fabricated, the seam being opened out for this purpose so that the two joined face sides are face downwards on the ironing table, the flat iron being laid on the opened-out seam allowances to press them flat against the fabric reverse sides, so that the seam allowances do not stick up from the fabric reverse side, which would lead to bulky, unsightly seams.

Various proposals have been made to carry out this seam setting operation mechanically, continuously with the production of the seam. However, such mechanical methods have not been used to the fullest extent in garment manufacturing.

SUMMARY OF THE INVENTION

The invention provides an improved method and means whereby seams can be set, continuously, if desired, with their production, eliminating the disadvantages of prior art mechanisms which limit the usefulness thereof.

The invention comprises a method and apparatus for setting a seam joining, along a seam line, two plies of fabric having face sides and reverse sides similarly orientated with respect to the seam, and further having seam allowances, so that when the plies are separated the seam allowances will tend to remain in contact each with the reverse side of its own ply, in which the plies are fed together along the seam line, the seam allowances are separated and folded back, the fabric is set during the said separating and folding back thereof, and the seam is constrained against lateral displacement during said separation and folding.

The setting may be by heat and steam setting, or by adhesive or other bonding, or by thermoplastic deformation, to cause the seam allowances to lie against the fabric reverse side or adhere thereto on either side of the seam.

Although the method can be carried out on a seam which has already been made, it is especially suitable for setting the seam continuously with the production of the seam, and will be so described herein.

As in prior art proposals, the seam may be guided by a blade between the adjacent fabric plies into a folder which turns the seam allowances in opposite directions against the fabric reverse sides, and pressure may be exerted on the seam when the seam allowances have been folded back with the fabric face sides in contact (or separated by the said blade.)

However, unlike the prior art proposals referred to, the setting action is preferably performed within a relatively short lengthwise extent, while the seam is under the control of a constraint against lateral displacement enabling more sharply curved seams to be set. Prior art proposals have been generally suitable only for relatively straight, long seams, such as a seam joining opposite edges of an open-width fabric to make a tubular fabric, or the seams of trouser legs, whereas the method according to this invention permits the setting (continuously with the sewing) of the seams of a raglan or other sleeve. The method becomes therefore of general interest to the entire garment trade.

When the method is used to set machine sewn seams continuously with their production, the constraint of the seam against lateral displacement is preferably effected by the sewing needle, throat plate, foot and feeder. To enable the setting apparatus to be as short as possible, the separation and turning-back of the seam allowances begin before the plies reach the needle, and a side iron co-operates with the presser foot and the edge of the throat plate to define a first narrow space, substantially perpendicular to the fabric plane, in which the upper seam allowance is guided, and a second such space for the lower seam allowance.

A practical form of apparatus for attachment to a sewing machine has a base plate carrying a temperature controlled heater and a source of steam, such as a water reservoir out of which water can be forced by air pressure, controlled by an adjustable valve, through a pipe coiled around the heater (which is preferably an electric heating element), or perhaps the water reservoir is mounted so as to feed gravitationally into the coil, and steam admitted to the folded seam by a treadle-operated valve between coil and seam presser. Conveniently, the plate may also carry a pair of output feed rollers (which may be knurled, better to grip the fabric) connectible to the main drive of the sewing machine, but these may well be mounted on the bed plate of the sewing machine to simplify the drive connection. To accommmodate different fabric thicknesses, there may be provided a resilience between the blade aforementioned and the fabric folder. Such blade may be held rigidly in position (although pivotable away completely to one side to facilitate removal of a partly sewn seam from the sewing machine, and to enable the machine to be used without the setting attachment operative, without having to remove the same completely from the machine) while a co-operating folding and pressing member is spring loaded for movement towards and away from the blade on the base plate.

BRIEF DESCRIPTION OF THE DRAWINGS

The method of setting a seam and embodiments of apparatus therefor according to the invention will now be described with reference to the accompanying drawings in which:

FIG. 2 is a plan view of the seam pressing attachment shown in FIG. 1, showing its position relative to the sewing needle, and FIG. 3 is a side elevation of part of the embodiment shown in FIGS. 1 and 2.

DESCRIPTION OF THE PREFERRED EMBODIMENTS

FIGS. 1*a* to 1*e*, which are views of successive positions in the progress of the fabrics through the seaming and setting operations, taken along the seam line, show the seam to be produced on a conventional sewing machine having a needle 13, a feeder 13*a* and a presser foot 13*b*. Two plies of fabric 11, 12 with their face sides in contact are sewn together (FIG. 1*a*) along the seam line, leaving seam allowances 11*a*, 12*a*. At the needle 13 position, these seam allowances are already being separated by a leading edge of a tongue 14. The face sides of the fabrics 11, 12 on the other side of the seam line are separated a little distance from the seam line by an arm 15*a* of a blade at this needle position. It will be appreciated that the feeder 13*a*, presser foot 13*b* and needle 13 co-operate to constrain the fabrics 11, 12 against any relative lateral displacement at this point.

Figure 1A:
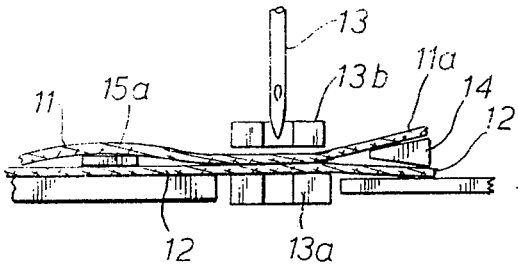
FIGS. 1*a* to 1*e* illustrate somewhat diagrammatically successive stages in the simultaneous sewing and pressing of a seam
Figure 1B:
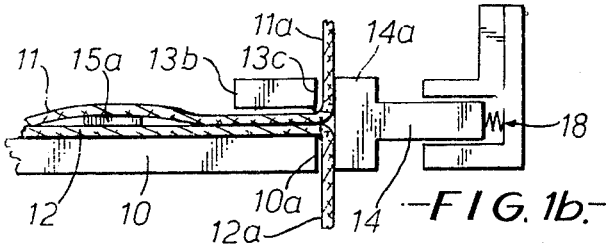
Figure 1C:
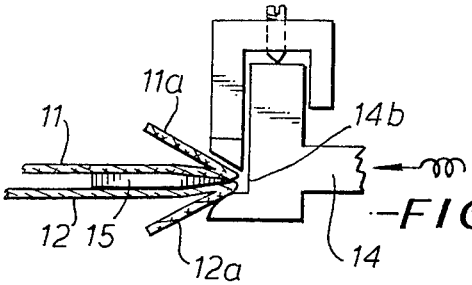

In FIG. 1*b*, which shows the position immediately after the needle position of FIG. 1*a*, the seam allowances 11*a*, 12*a* are each folded back 90° by a side iron portion 14*a* of the tongue 14, one, 11*a* to lie against the edge 13*c* of the presser foot 13*b*, the other, lower, seam allowance 12*a* to lie against an edge 10*a* of the sole plate 10. The entire tongue 14 is heated, and it is also resiliently biassed towards the edge 13*c* and the edge 10*a*, which are both fixed against lateral movement, so that the seam is here pressed open. This resilient biassing of the tongue 14 enables occasional bulges and thickenings of the fabrics to be accommodated, as, for example, when belts or loops are to be incorporated into the seam. At this point, or somewhere between this point and the position shown in FIG. 1*a*, steam is injected into the seam (see FIGS. 2 and 3.)

Immediately after leaving the edges 13*c* and 10*a*, the seam allowances are folded further back by the tongue 14, which now has a channel 14*b* (defined between a base 14*d* and a resiliently mounted upper iorn 16) into which the blade 15 holds the seam. The blade 15 is, like the edges 13*c* and 10*a*, fixed against lateral displacement, and the resilient bias on the tongue 14 urges the seam on to the blade 15.

Directly after this, the channel 14*b* widens into a slot between the base 14*d* and the upper iron 16, which is mounted on the tongue 14 and biassed down towards the base 14*d*, but with an adjustable minimum spacing fixed by a stop 17. The blade 15 still holds the seam between base 14*d* and upper iron 16, which presses the seam on to the blade 15 while allowing, through the mutual resilience, for the occasional thick parts of the seam as before.

The tongue 14 and the iron 16 are in good thermal contact with a thermostatically controlled electric heating element as will be explained below.

Figure 1E:
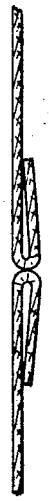
Figure 1D:
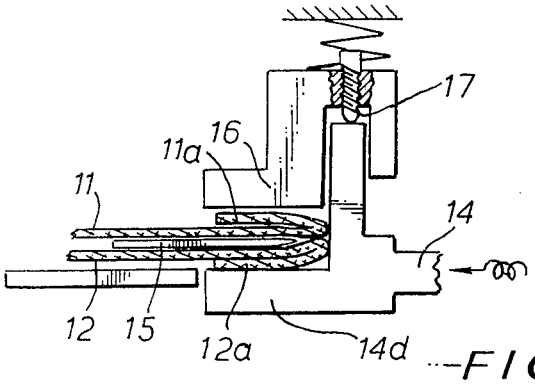

When the seam is opened out, as shown in FIG. 1*e*, after removal from the apparatus, the seam allowances 11*a*, 12*a* lie flat against the fabric reverse sides the whole length of the seam, and need have no further pressing.

The short distance, preferably no more than about 70 to 100 mm between the production fo the seam at the position of the needle 13 and the completion of the pressing process in the irons 14*d* and 16 ensure that the seam is constrained the whole time against lateral displacement. Beginning the pressing operation between presser foot 13*b* and throat plate edge 10*a* on the one side, and side iron 14*a* on the other side further discourages any tendency of the seam to lateral displacement and the final setting step with the seam allowances folded back against the fabric reverse sides between the irons 14*d* and 16 is carried out to set a crease along the seam line, rather than to one side, which would result in an unsightly seam which would require to be pressed again after the garment had been partially finished. The apparatus enables the degree of control over the pressing action to be maintained even on sharply curved seams.

The stop 17 and, if desired, a similar adjustable spring biassing arrangement 18 limiting movement of the tongue away from the presser foot edge 13*c* and the throat plate edge 10*a*, allow the apparatus to be correctly adjusted to accommodate different fabric thicknesses or numbers of plies.

The plan view in FIG. 2 shows the balde 15 pivoted on a post 15*b*. It can be locked in operative position by a tag (not shown) engaging a notch on a separate base plate to which it is fixed. This pivotal mounting is provided to facilitate removal of the fabrics 11, 12 from the apparatus when they have been partially sewn, and, in addition, means that the blade can be swung away quite clear of the needle to permit ordinary sewing not requiring seam pressing to be carried out easily without dismantling the entire apparatus.

The heating element for the processing apparatus comprises a block 21 of heat conductive material mounted on the base 22 with an electric resistance wire fixed to it and a temperature sensing device 23 connected to a controller 24 for the supply of current to the element. Around the block is wrapped a stainless steel tube 25 connected by a flexible tube 26 to the nozzle 14*c* (FIGS. 2 and 3) and fed with water from a reservoir 29. Steam is admitted to the nozzle by a treadle-operated valve 28, which is actuated at the start of each sewing operation. The valve can, of course, be rendered inoperative for ordinary sewing, when steam is not required.

The base 22 carrying the tongue 14, heating element 21 and other components is slidably retained on the sewing machine bed plate by channels 20 engaged on posts 19, enabling the apparatus to be displaced to the side to permit ordinary sewing, not requiring seam pressing, to be carried out again without completely removing the apparatus from the sewing machine.

The positions corresponding to FIGS. 1*a* to 1*d* are shown on FIG. 2, from which it can be seen that the arrangement is lengthwise very compact.

Output rollers 27 mounted on the bed plate of the sewing machine are connected to be driven from the main drive shaft of the sewing machine (not shown).

Further to enable the overall length of the apparatus to be as small as possible, a special high speed feeding presser foot has been devised, in which the springing of the fabric contacting portion is effected by a compression spring mechanism 31 carried on the mounting body 32 in front, rather than behind, as is conventional, thus enabling the rest of the apparatus to be brought closer to the needle.

I claim:

1. A method for setting a seam joining, along a seam line, two plies of fabric having face sides and reverse sides similarly orientated with respect to the seam, and further having seam allowances, so that when the plies are separated the seam allowances will tend to remain in contact each with the reverse side of its own ply, comprising the steps of:

a. feeding the plies together along the seam line;
b. separating and folding back the seam allowances;
c. setting the fabric during the said separating and folding step; and
d. constraining the seam against lateral displacement during said separating and folding step.

2. A method according to claim 1, also comprising the step of producing the seam continuously therewith.

3. A method according to claim 2, in which the step of producing the seam comprises sewing the seam.

4. A method according to claim 3, in which the said lateral constraining of the seam is effected by the action of sewing the seam.

5. A method according to claim 1, in which the setting step comprises heating the fabric.

6. A method according to claim 1, in which the setting step comprises heating the fabric in the presence of moisture.

7. A method according to claim 1, in which steam is supplied to the fabric during the said setting step.

8. A method according to claim 3, in which the said separating and folding step begins before the fabric reaches the seaming step.

9. A method according to claim 8, in which the said setting step begins before the fabric reaches the said seaming step.

10. Apparatus for setting a seam joining, along a seam line, two plies of fabric having face sides and reverse sides similarly orientated with respect to the seam and further having seam allowances, so that when the plies are separated the seam allowances will tend to remain in contact each with the reverse side of its own ply, comprising a fabric edge folder comprising tongue means adapted to divide adjacent edges of the two plies of fabric fed thereto, guide means adapted to turn said edges so that said edges lie against the outwardly facing reverse sides of the plies, and pressing means adapted to press the thus turned edges together; setting means adapted to set the fabric edges in said turned back condition; and seam constraining means adapted to locate the seam against lateral displacement in said setting means.

11. Apparatus according to claim 10, further comprising fabric feeding means adapted to feed the fabric through said folder and setting means.

12. Apparatus according to claim 10, further comprising seam producing means adapted to produce said seam continuously with the folding and setting thereof.

13. Apparatus according to claim 12, in which said seam producing means comprise sewing apparatus.

14. Apparatus according to claim 13, in which said sewing apparatus comprises a sewing needle, a feed dog and a presser foot.

15. Apparatus according to claim 10, in which said setting means comprise heatable parts of said folder and heating means to heat the same.

16. Apparatus according to claim 10, in which said setting means comprise steam supply means comprising a steam generator and steam supply tubing disposed to deliver steam from said generator to said folder.

17. Apparatus according to claim 13, in which said sewing apparatus is located between said tongue means and said pressing means.

18. Apparatus according to claim 15, in which all the parts of said folder are in good thermal connection with said heating means whereby said tongue means and said guide means can be heated so as to participate in said setting in addition to said pressing means.

* * * * *